US005517293A

United States Patent [19]

Tonai et al.

[11] Patent Number: 5,517,293

[45] Date of Patent: May 14, 1996

[54] HEAT ROLLER FIXING APPARATUS WITH ROTATING LAMPS

[75] Inventors: Keiko Tonai; Katsumi Sugimoto, both of Kawasaki, Japan

[73] Assignee: Fujitsu Limited, Kawasaki, Japan

[21] Appl. No.: 431,977

[22] Filed: May 1, 1995

[30] Foreign Application Priority Data

May 31, 1994 [JP] Japan ..... 6-141232

[51] Int. Cl.[6] ..... G03G 15/20

[52] U.S. Cl. ..... 355/285; 219/216; 219/470; 432/60

[58] Field of Search ..... 355/285, 289, 355/290; 219/216, 467, 470, 471; 432/59, 60

[56] References Cited

U.S. PATENT DOCUMENTS 2,588,966 6/1947 Dale ..... 219/469

FOREIGN PATENT DOCUMENTS 59-121366 7/1984 Japan .
64-79780 3/1989 Japan .

*Primary Examiner*—Joan H. Pendegrass
*Attorney, Agent, or Firm*—Armstrong, Westerman, Hattori, McLeland & Naughton

[57] ABSTRACT

Disclosed is a heat roller fixing apparatus for performing a thermal fixation onto a sheet by rotating a heat roller. This heat roller fixing apparatus comprises a heat roller including a roller body and a plurality of heating members provided in the roller body and a pressurizing member provided in a face-to-face relationship with the heat roller. This heat roller fixing apparatus has a rotation mechanism for rotating the plurality of heating members along an inner periphery of the roller body and a control unit for drive-controlling the rotation mechanism during a standby status for driving the heating members without rotating the roller body. An unevenness in preheating on the surface of the roller body of the heat roller is thereby prevented.

9 Claims, 9 Drawing Sheets

HEAT ROLLER FIXING APPARATUS WITH ROTATING LAMPS

BACKGROUND OF THE INVENTION

1. Field of the Invention

The present invention relates generally to a heat roller fixing apparatus for thermally fixing a toner image on a sheet and, more particularly, to a heat roller fixing apparatus for preventing an unevenness in temperatures during a standby status.

2. Description of the Related Art

In an image forming apparatus such as a copying machine, a printer, a facsimile, etc., a latent image forming type recording apparatus like an electrophotographic apparatus has been utilized. In such an image forming apparatus, an electrostatic latent image is formed on a photosensitive drum and thereafter developed, thus forming a toner image. Then, after transferring the toner image on the photosensitive drum onto a sheet, the toner image is fixed onto the sheet by heating.

A heat roller fixing device, a flash lamp fixing device and a pressure fixing device may be given as this type of fixing device. Among these fixing devices, the heat roller fixing device has been widely utilized because of its simple construction. This heat roller fixing device effects preheating in a standby status. It is desirable that the thermal fixation be immediately stably done upon an incoming of a print command from this standby status.

The heat roller fixing device, heats up the roller by use of halogen lamps. Then, the fixing is performed with the aid of the heat thereof and a pressure between the former roller and a roller on the opposite side while a sheet is sandwiched in therebetween.

On the other hand, a fixing energy E needed for the fixation is a sum of an energy E1 required mainly for melting a toner and an energy E2 absorbed by the sheet. In the color image forming apparatus, with respect to these energies E1 and E2, when a fixing energy E for monochromatic printing is compared with a fixing energy E for color printing, the energy E2 absorbed by the sheet does not change. Because of factors such as a toner layer thickness, etc., however, the energy E1 needed for melting the toner changes depending on the toner layer thickness.

In a comparison in terms of the toner layer thickness between the monochromatic printing and the color printing, the monochromatic printing has a toner layer thickness for one layer. Contrastingly, the color printing entails a superposition of colors and therefore has two layers in the case of multi colors (seven colors) but four layers in the case of full colors. For this reason, the color printing requires a larger energy needed for melting the toner than in the monochromatic printing.

Therefore, the fixing energy is set as an energy needed for the fixing in the full color printing, and the fixing is, it can be considered, done with this energy in the chromatic printing, too. According to this method, however, the energy necessary for the fixing in the full color printing is twice or above as large as the energy for the monochromatic printing, and therefore, in the case of the monochromatic printing, the electric power is dissipated with a large futility.

Similarly, when an ambient temperature is high, the fixing with a large amount of energy leads to the futility of the electric power dissipated. As a method of preventing this, it is proposed that a plurality of halogen lamps are provided within the heat roller.

Based on this method, the minimum electric power quantity required can be supplied depending on the print types, i.e., the monochromatic printing and the color printing as well as on a magnitude of the ambient temperature. The dissipation quantity of the electric power can be thereby reduced.

There arise, however, the following problems inherent in the prior art.

The heat roller fixing device is required to immediately perform the fixing upon the incoming of the print command in the standby status where the print command does not yet come. For this reason, such a heat roller fixing device effects preheating at a temperature (e.g., 160° C.) lower than a fixing temperature (e.g., 180° C.) in the standby status.

In the standby status where the heat roller temperature is the fixing temperature or under, the toner is fixedly adhered to a cleaner and a sheet separation pawl that are brought into contact with the heat roller. Therefore, when rotating the heat roller, the surface of the heat roller is easy to damage. For this reason, the heat roller is not rotated in this standby status.

Accordingly, the heat roller equipped with the plurality of halogen lamps serving as the above-mentioned heating members performs the preheating by use of some of the halogen lamps. This conduces to such a problem that the surface temperatures of the heat roller are not uniform. Hence, even when heated at the above fixing temperature, there arises a problem in which the unevenness in the fixing appears due to the ununiformity in the surface temperatures when the initial printing is conducted.

SUMMARY OF THE INVENTION

It is a primary object of the present invention to provide a heat roller fixing apparatus capable of preventing an unevenness in fixing when initial printing is carried out.

It is another object of the present invention to provide a heat roller fixing apparatus capable of uniformizing surface temperatures of a heat roller in a standby status in a heat roller fixing apparatus including a plurality of heat sources provided in a heat roller.

To accomplish the objects given above, according to one aspect of the present invention, a heat roller fixing apparatus for performing a thermal fixation onto a sheet by rotating a heat roller has a heat roller including a roller body and a plurality of heating members provided in the roller body and a pressurizing member provided in a face-to-face relationship with the heat roller. This heat roller fixing apparatus also has a rotation mechanism for rotating the plurality of heating members along an inner periphery of the roller body and a control unit for drive-controlling the rotation mechanism in a standby status for driving the heating members without rotating the roller body.

According to the present invention, the plurality of heating members are rotated in the standby status where the heating members are operated without rotating the roller body. Therefore, even when some heating members 51 are operated, the surface temperatures of the roller body can be uniformized. The surface temperatures of the roller body can be thereby uniformized in the standby status. Accordingly, the unevenness in the fixing can be prevented even when the fixing is immediately conducted upon an incoming of a print command.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
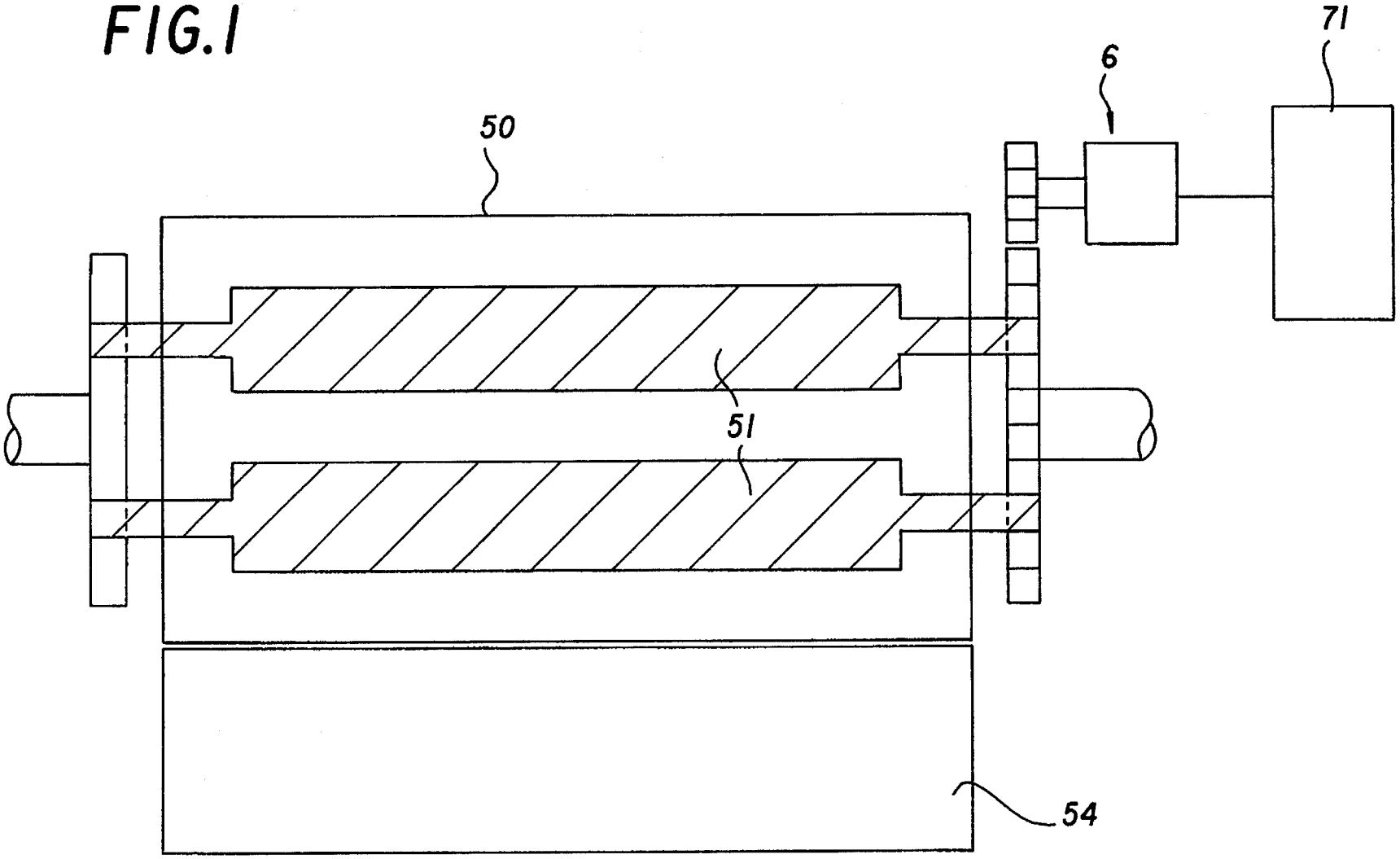
FIG. 1 is a diagram showing the principle of the present invention.

FIG. 1 is a diagram showing the principle of the present invention.

As illustrated in FIG. 1, a heat roller has a roller body 50. An interior of this roller body 50 is provided with a plurality of heating sources 51. A pressurizing roller 54 is disposed in a face-to-face relationship with the heat roller. A rotating mechanism 6 causes the plurality of heating sources 51 to rotate.

A control mechanism 71 controls the rotating mechanism 6. In a standby status, the roller body 50 does not rotate, but the heating sources 51 are driven. Preheating is thereby effected. This control mechanism 71 drives the rotating mechanism 6 in the standby status.

Figure 2:
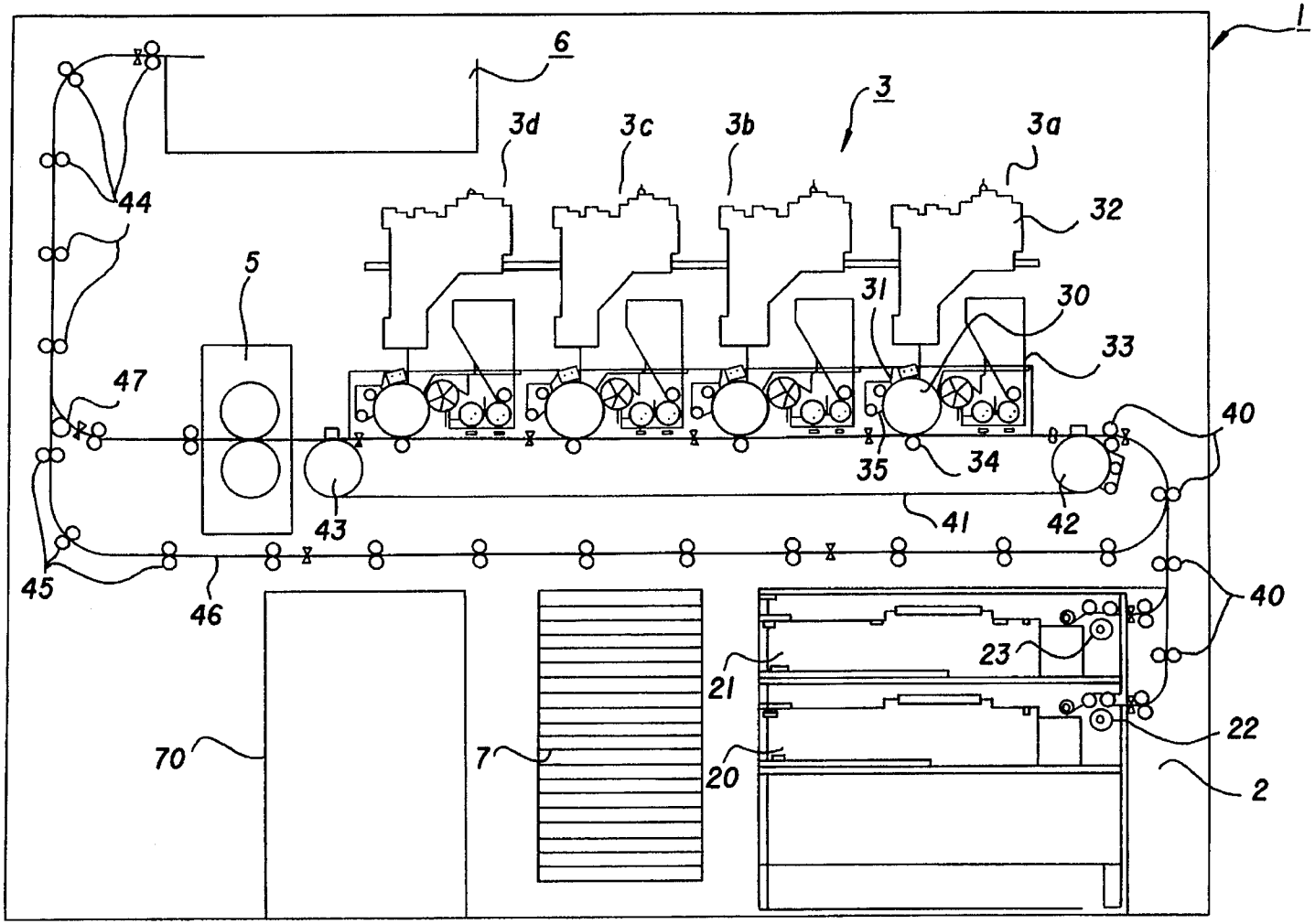
FIG. 2 is a view illustrating a construction of a color printer in one embodiment of the present invention.

FIG. 2 is a view showing a construction of a color image forming apparatus in one embodiment of the present invention. In accordance with this embodiment, the color image forming apparatus is shown in the form of a color electrophotographic printer.

As depicted in FIG. 2, a color electrophotographic printer 1 includes a hopper 2 for housing sheets, an image forming unit 3 for forming a toner image on one surface of the sheet and a sheet feeding system 4. The printer 1 further includes a fixing device 5 for fixing the toner image on the sheet, a stacker 6 for housing the sheets discharged, a control circuit 7 and a power supply 70.

The hopper 2 has two stages of sheet cassettes 20, 21. These sheet cassettes 20, 21 are attachable and detachable from the front surface of the apparatus. Provided also are pickup units 22, 23 for picking up the sheets out of these sheet cassettes 20, 21 and the separates the sheets. The image forming unit 3 includes electrophotographic mechanisms 3*a*, 3*b*, 3*c*, 3*d* for forming toner images in full colors, i.e., magenta, yellow, cyan and black.

These electrophotographic mechanisms 3*a*, 3*b*, 3*c*, 3*d* have configurations marked with the numerals 30–35. A photosensitive drum 30 is constructed of a metal drum coated with a photo conductive layer along its periphery and rotates clockwise. A pre-charger 31 uniformly charges the photosensitive drum 30. A laser optical system 32 works to expose a photo image on the photosensitive drum 30, thereby forming an electrostatic latent image on the photosensitive drum 30. A developing unit 33 supplies the photosensitive drum 30 with a developer, and the electrostatic latent image is developed by the developer, thus forming a toner image. A transfer roller 34 serves to transfer the toner image on the photosensitive drum 30 onto a sheet fed. Adeelectrifier and a cleaner 35 work to remove residual electric charges on the photosensitive drum 30 and, thereafter, clean off the residual toners.

Note that the developing unit 33 of each of the electrophotographic mechanisms 3*a*, 3*b*, 3*c*, 3*d* accommodates developers assuming colors such as magenta, yellow, cyan and black and supplies the photosensitive drum 30 with these developers.

The sheet feeding system 4 is provided with feed rollers 40 for feeding the sheets from the sheet cassettes 20, 21 to an entrance of the toner image forming unit 3. Provided also is a belt feed mechanism 41, 42, 43 for feeding the sheets from the entrance of the image forming unit 3 to an exit.

This belt feed mechanism is constructed in such a way that an electrostatic adsorption belt 41 is stretched between a pair of rollers 42, 43. The electrostatic adsorption belt 41 moved by the rollers 42, 43 feed the sheet from the entrance of the toner image forming unit 3 to the exit. A positional deviation of the sheet can be restrained down to the minimum in a transfer position of each of the electrophotographic mechanisms 3*a*, 3*b*, 3*c*, 3*d* by use of this electrostatic adsorption belt 41.

Also, in the sheet feeding system 4, discharge rollers 44 for feeding the sheet from the fixing device 5 to the stacker 6 are disposed posterior to the fixing device 5. Further, a mechanism for double-side printing is provided. That is, a reverse path 46 for feeding the sheets is formed extending from the posterior of the fixing device 5 to the entrance of the toner image forming unit 3. A multiplicity of feed rollers 45 are provided in this reverse path 46. Further, a reverse impeller 47 is disposed behind the fixing device 5.

The operation of this printer will be explained. The sheets are sent out by the pick mechanisms 22, 23 from the sheet cassettes 20, 21 and thereafter fed to the entrance of the image forming unit 3 by the feed rollers 40. These sheets are fed by the belt feed mechanism 41, 42, 43 to each of the electrophotographic mechanisms 3*a*, 3*b*, 3*c*, 3*d*. Meanwhile, the transfer rollers 34 transfer the toner image, assuming each color, on the photosensitive drum 30 of each of the electrophotographic mechanisms 3*a*, 3*b*, 3*c*, 3*d* onto one surface of the sheet. Then, the sheet is fed to the fixing device 5, wherein the toner image is thermally fixed. The sheet fixed with the image is fed toward the stacker 6 by the discharge rollers 44.

For effecting the double-side printing, when the trailing edge of the sheet reaches the reverse impeller 47, the feed of the sheet is stopped. Then, the impeller 47 is rotated counterclockwise, thereby directing the trailing edge of the sheet toward the reverse path 46. Subsequently, the discharge rollers 44 are reversely rotated, and the feed rollers 45 are also rotated, thereby feeding the sheet along the reverse path 46 toward the entrance of the toner image forming unit 3.

The sheet reaching the entrance of the toner image forming unit 3 is, as in the same way with the above-mentioned one-side printing, fed by the belt feed mechanism 41, 42, 43 to each of the electrophotographic mechanisms 3*a*, 3*b*, 3*c*, 3*d*. Meanwhile, the transfer rollers 34 transfer the toner image, assuming each color, on the photosensitive drum 30 of each of the electrophotographic mechanisms 3*a*, 3*b*, 3*c*, 3*d* onto the opposite surface of the sheet. Then, the sheet is fed to the fixing device 5, wherein the toner image is thermally fixed. The sheet fixed with the image is discharged to the stacker 6 by the discharge rollers 44. The double-side printing is carried out in this manner.

As a matter of course, when effecting one-side printing, after performing the printing on one side of the sheet, the sheet is discharged to the stacker 6 by the discharge rollers 44.

Based on such a construction, the double-side printing is performed by reversing the sheet while making use of a space between the hopper 2 and the image forming unit 3, and, therefore, the color double-side printing apparatus can be constructed in a small size. Further, the feed path 4 extending from the hopper 2 to the stacker 6 is formed in an S-shape, and, hence, the down-sizing of the color printing apparatus can be attained. Moreover, since the electrostatic adsorption belt 41 is employed, it is possible to form the color image exhibiting a trace of color difference between the respective colors.

Figure 3:
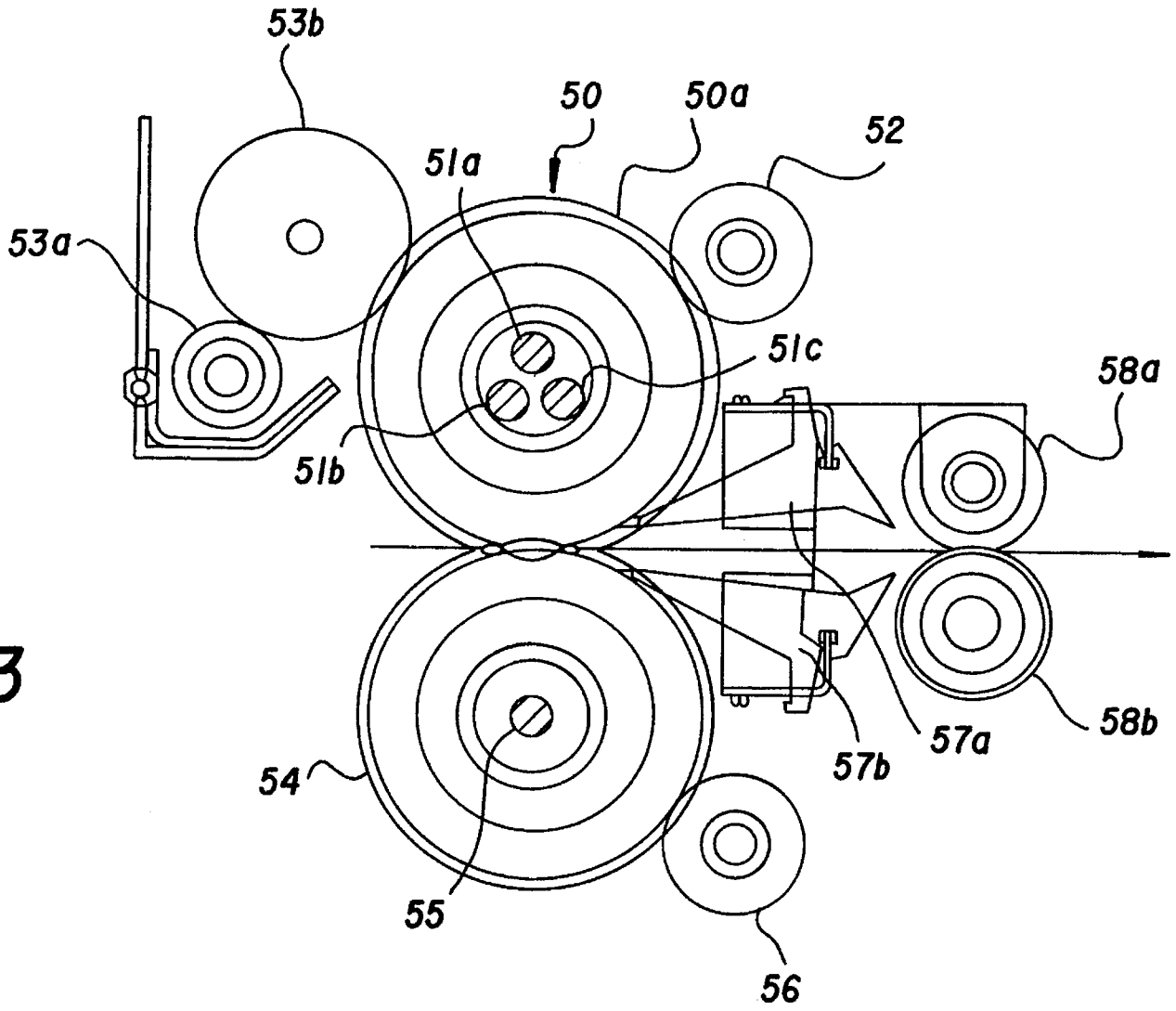
FIG. 3 is a view illustrating a configuration of a fixing apparatus of FIG. 2.

FIG. 3 is a view illustrating a configuration of the fixing apparatus in one embodiment of the present invention. Referring to FIG. 3, the sheet is fed in the right direction in the Figure irrespective of the placement of FIG. 2.

Referring again to FIG. 3, the heat roller 50 incorporates three pieces of halogen lamps 51*a*, 51*b*, 51*c* as a heat source (heater) in the interior of a heat roller body 50*a*. A cleaning roller 52 cleans contaminations adhered to the surface of the heat roller body 50*a*. Oil supply rollers 53*a*, 53*b* supply the surface of the heat roller body 50*a* with an oil (lubrication oil).

A backup roller (pressurizing roller) 54 incorporates one halogen lamp 55 serving as a heat source (heater) in its interior. This pressurizing roller 54 is pressed by the heat roller 50, thus feeding the sheet sandwiched therebetween. A cleaning roller 56 cleans the contaminations adhered to the pressurizing roller 54. Respective separation pawls 57*a*, 57*b* prevent the sheet from being wound on the heat roller 50 and the pressurizing roller 54, respectively. Discharge rollers 58*a*, 58*b* discharge the image-fixed sheet.

Figure 4:
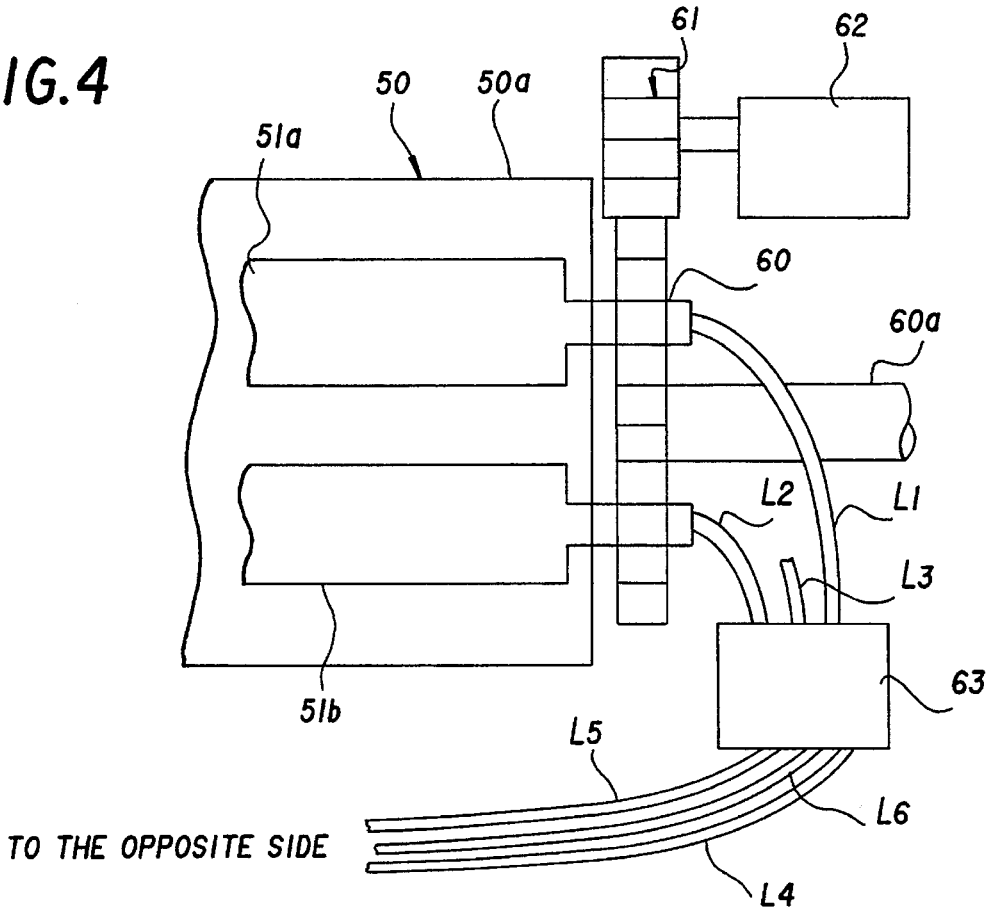
FIG. 4 is a cross sectional view of the fixing apparatus of FIG. 2.
Figure 5:
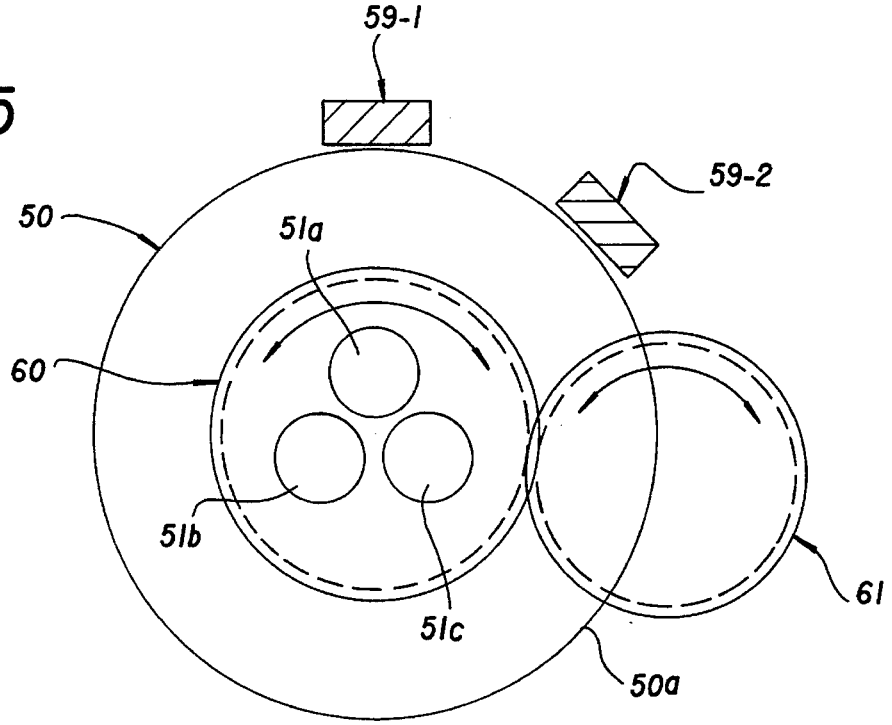
FIG. 5 is a front view of the fixing apparatus of FIG. 2.

FIG. 4 is a cross sectional view illustrating the thermal roller fixing apparatus in one embodiment of the present invention. FIG. 5 is a front view thereof.

As shown in FIGS. 4 and 5, one edges of the halogen lamps 51*a*–51*c* are held by a lamp holding plate 60. This lamp holding plate 60 is rotatable about a shaft 60*a*. The lamp holding plate 60 takes a circular shape and is formed with teeth along its periphery. The teeth of this lamp holding plate 60 mesh with a drive gear 61.

This drive gear 61 is set in a shaft of a motor 60 (e.g., a stepping motor). Connection lines L1–L3 for supplying the electric power from a power supply 63 are connected to the edge portions of the respective halogen lamps 51*a*–51*c*. Further, connection lines L4–L6 extending from the power supply 63 are connected to the other edges (unillustrated) of the respective halogen lamps 51*a*–51*c*.

First and second temperature detecting elements 59-1, 59-2 are provided on the periphery of this heat roller body 50*a* in such a manner that positions thereof are different in its peripheral direction. The first and second temperature detecting elements 59-1, 59-2 are constructed of thermistors.

Figure 6:
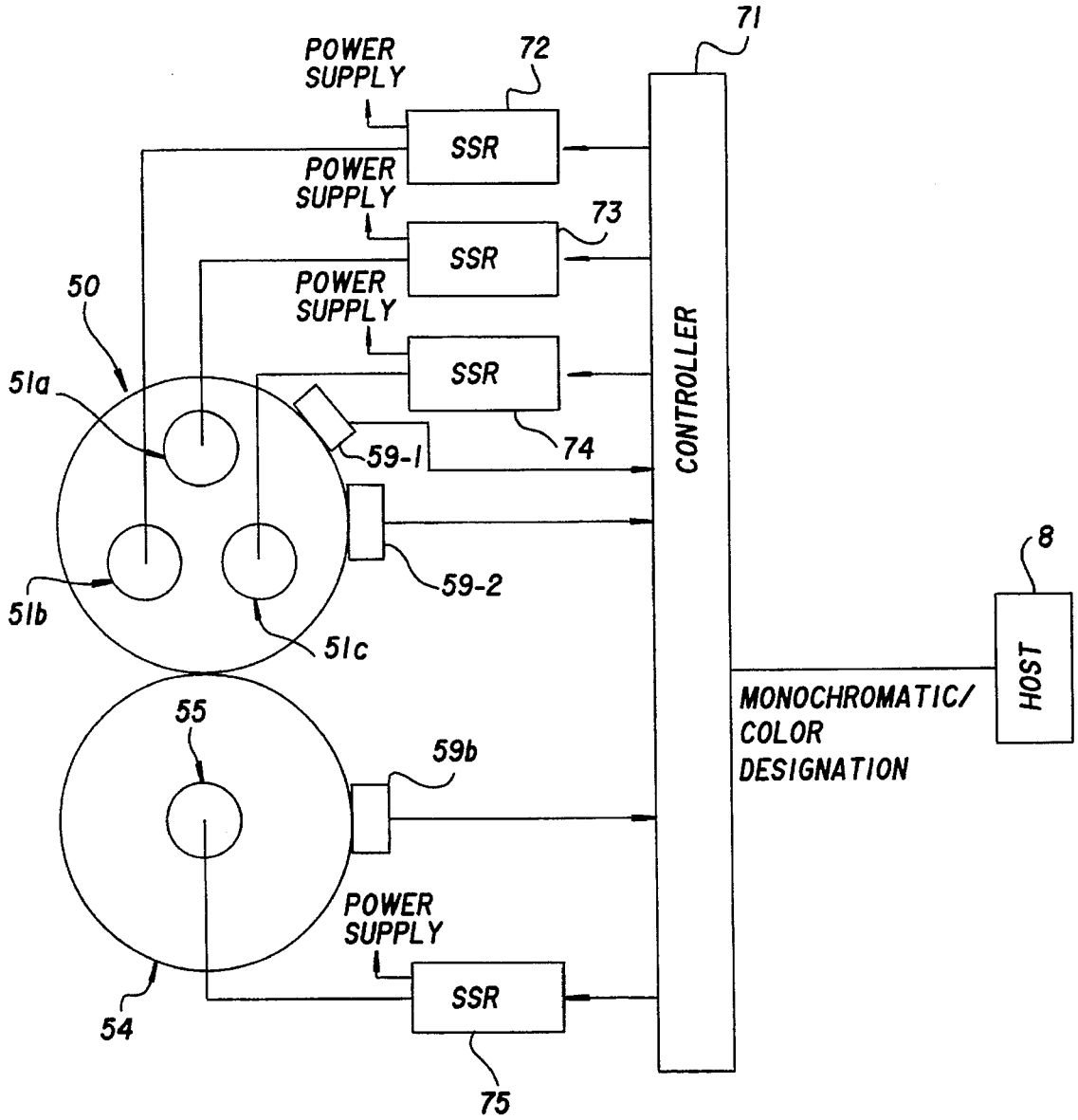
FIG. 6 is a control block diagram in one embodiment of the present invention.

FIG. 6 is a control block diagram in one embodiment of this invention.

As illustrated in FIG. 6, the pressurizing roller 54 is fitted with a third temperature sensor 59*b*. This temperature sensor 59*b* serves to detect a temperature of the pressurizing roller 54. A microcomputer-assisted controller 71 controls respective elements of the electrophotographic mechanisms 3*a*–3*d* and, at the same time, controls the halogen lamps 51*a*–51*c* of the heat roller 50 of the fixing device 5 and the halogen lamp 55 of the pressurizing roller 54.

Set/reset switch circuits 72, 73, 74, 75 apply application voltages from the respective power supplies to the halogen lamps 51*a*–51*c*, 55 on the basis of an indication of the controller 71. A host computer 8 gives an indication of monochromatic printing/color printing to the controller 71 and, at the same time, transfers the print data.

Herein, the monochromatic printing, the multi-color printing and the full color printing are considered. A toner has a one-layered thickness in the case of the monochromatic printing. An ill-fixed state is seen at a fixing temperature of 130° C. or under. If over 180° C., an offset is produced. For this reason, it is desirable that the fixing temperature be within a range of 130° C.–180° C.

Further, the toner has a two-layered thickness in the case of the multi-color printing. The ill-fixed state is also seen at a fixing temperature of 140° C. or under. Further, if over 190° C., the offset is caused. Therefore, it is desirable that the fixing temperature be within a range of 140° C.–190° C. Moreover, the toner has a four-layered thickness in the case of the full color printing. The ill-fixed state is also seen at a fixing temperature of 160° C. or under. Further, if over 200° C., the offset is caused. Hence, it is desirable that the fixing temperature be within a range of 160° C.–200° C.

From the above-mentioned, if the fixing temperature falls within the range of 160° C.–180° C., the fixing can be well performed by making the fixing temperature constant irrespective of the toner layer thickness. That is, the well-fixed state is attainable by controlling the set temperature at a constant level.

Obtained next is an electric power quantity required for acquiring a fixing energy in each toner layer thickness. An electric power quantity of 1125 W is needed in the case of one toner layer. An electric power quantity of 2250 W is needed in two toner layers, and 4500 W is required in four toner layers.

Then, in this embodiment, as illustrated in FIG. 6, the interior of the heat roller 50 which fixes the toner of the sheet is provided singly with the halogen lamps 51*a*, 51*b*, 51*c* of 450 W, 1550 W, 1800 W. Further, the pressurizing roller 54 on the opposite side is provided with the single halogen lamp 55 of 700 W.

Figure 7:
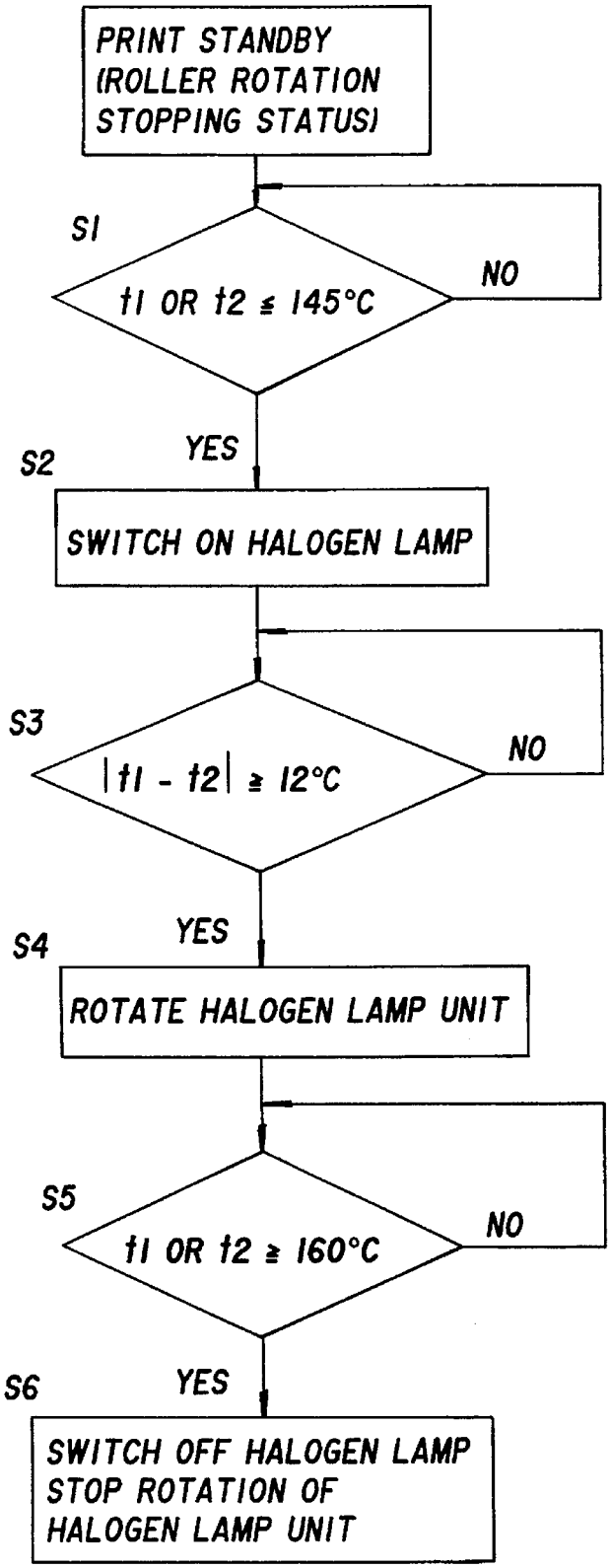
FIG. 7 is a flowchart showing processes during a standby status in one embodiment of the present invention.

FIG. 7 is a standby processing flowchart in one embodiment of the present invention.

(S1) with respect to a print standby status, i.e., in a state where the heat roller 50 is not rotated, the controller 71 checks whether or not a detected temperature t1 or t2 of one of the first thermistor 59-1 and the second thermistor 59-2 is lower than 145° C.

(S2) The controller 71, if the detected temperature t1 or t2 of one of the first and second thermistors 59-1, 59-2 is 145° C. or under, switches ON the halogen lamp to effect heating. For example, the halogen lamp 51*a* is switched ON through the set/reset switch circuit 73.

(S3) Next, the controller 71 reads the detected temperatures t1, t2 of the first and second thermistors 59-1, 59-2.

Then, the controller 71 examines whether or not an absolute value of a temperature difference (t1–t2) between the first and second thermistors 59-1 and 59-2 is 12° C. or higher. If the absolute value of the temperature difference (t1–t2 ) between the first and second thermistors 59-1 and 59-2 is 12° C. or higher, the controller 71 determines that temperatures of the heat roller body 50*a* in the peripheral direction are not uniform.

(S4) The controller 71, if the absolute value of the temperature difference (t1–t2) between the first and second thermistors 59-1 and 59-2 is 12° C. or higher, drives a motor 62 to rotate the halogen lamp holding plate 60. At this time, because of existences of the connection lines L1–L6, the motor 62 is driven in reciprocation to rotate the halogen lamp holding plate 60 in reciprocation. It follows that the halogen lamps 51*a*–51*c* are rotated in reciprocation. A rotary angle of this reciprocating rotation is determined enough not to disconnect the connection lines L1–L6.

(S5) The controller 71 checks whether or not the detected temperature t1 or t2 of one of the first and second thermistors 59-1, 59-2 reaches a preheating temperature 160° C. or higher.

(S6) The controller 71, if the detected temperature t1 or t2 of one of the first and second thermistors 59-1, 59-2 reaches the preheating temperature 160° C. or above, switches OFF the halogen lamp 51*a* through the set/rest switch circuit 73. Further, the controller 71 stops driving the motor 62.

During the print standby status, this operation is repeated. Thus, during the print standby status, one halogen lamp is switched ON to perform the preheating. Then, in this state, the plurality of halogen lamp units are rotated. It is therefore possible to prevent the temperature ununiformity of the heat roller body 50*a* in the peripheral direction.

Next, the operation after receiving a print command will be explained.

Figure 8:
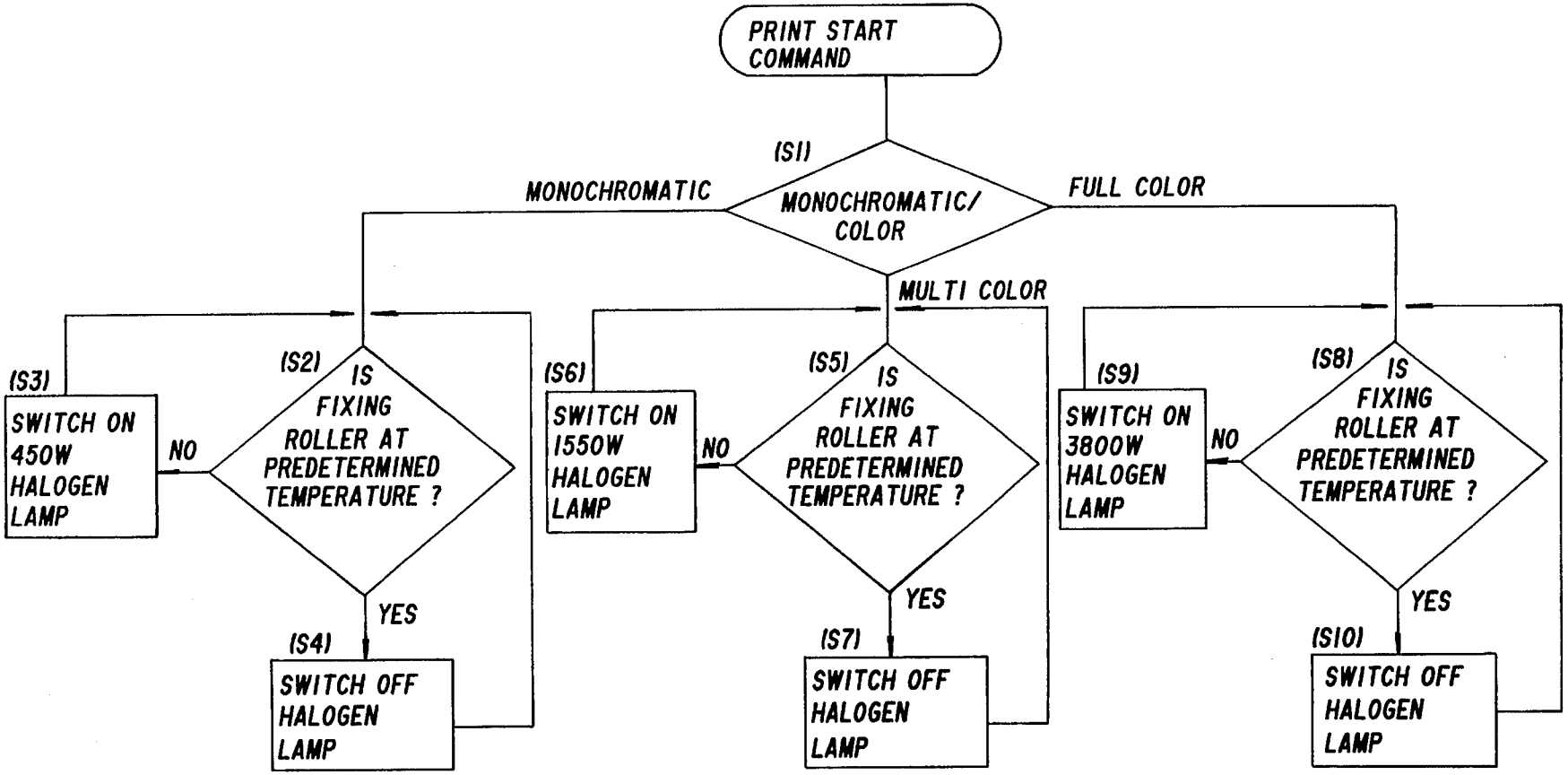
FIG. 8 is a flowchart showing processes on the side of a heat roller in one embodiment of the present invention.

FIG. 8 is a processing flowchart on the side of the heat roller in one embodiment of the present invention.

(S11) The controller 71, upon receiving a print start command from the host computer 8, checks whether the print start indication given from the host computer 8 is directed to the monochromatic printing or the multi-color printing or the full color printing.

(S12) The controller 71, when determining that the monochromatic printing is indicated, examines a detected temperature of the temperature sensor 59-1 of the heat roller 50.

(S13) The controller 71, if the detected temperature is not a predetermined temperature (e.g., 170° C.), sets the set/reset switch circuit 73 to apply the voltage to the 450 W halogen lamp 51*a*. The halogen lamp 51*a* is thereby heated up enough to generate a heat quantity of 450 W. At this time, the halogen lamp 55 of the pressurizing roller 54 generates a heat quantity of 700 W, and the heat quantity therefore amounts to totally 1150 W enough to dissolve one-layered toner. Then, thereafter, the processing returns to step S12.

(S14) The controller 71, whereas if the detected temperature is the predetermined temperature or above, resets the set/reset switch circuit 73 to stop applying the voltage to the 450 W halogen lamp 51*a*. The halogen lamp 51*a* is thereby switched OFF. Then, thereafter, the processing goes back to step S12.

(S15) The controller 71, when determining that the multi-color printing is indicated in step S11, examines a detected temperature of the temperature sensor 59-1 of the heat roller 50.

(S16) The controller 71, if the detected temperature is not the predetermined temperature (e.g., 170° C.), sets the set/reset switch circuit 72 to apply the voltage to the 1550 W halogen lamp 51*b*. The halogen lamp 51*b* is thereby heated up enough to generate a heat quantity of 1550 W. At this time, the halogen lamp 55 of the pressurizing roller 54 generates a heat quantity of 700 W, and hence the heat quantity amounts to totally 2250 W enough to dissolve two-layered toner. Then, thereafter, the processing returns to step S15.

(S17) The controller 71, whereas if the detected temperature is the predetermined temperature or above, resets the set/reset switch circuit 72 to stop applying the voltage to the 1550 W halogen lamp 51*b*. The halogen lamp 51*b* is thereby switched OFF. Then, thereafter, the processing goes back to step S15.

(S18) The controller 71, when determining that the full color printing is indicated in step S11, examines a detected temperature of the temperature sensor 59-1 of the heat roller 50.

(S19) The controller 71, if the detected temperature is not the predetermined temperature (e.g., 170° C.), sets the set/reset switch circuits 73, 72, 74 to apply the voltages to three pieces of 450 W, 1550 W, 1800 W halogen lamps 51*a*, 51*b*, 51*c*. The halogen lamps 51*a*, 51*b*, 51*c* are thereby heated up enough to generate a heat quantity of 3800 W. At this time, the halogen lamp 55 of the pressurizing roller 54 generates a heat quantity of 700 W, and the heat quantity therefore amounts to totally 4500 W enough to dissolve four-layered toner. Then, thereafter, the processing returns to step S18.

(S20) The controller 71, whereas if the detected temperature is the predetermined temperature or above, resets the set/reset switch circuits 73, 72, 74 to stop applying the voltages to three pieces of 450 W, 1550 W, 1800 W halogen lamps 51*a*, 51*b*, 51*c*. The halogen lamps 51*a*, 51*b*, 51*c* are thereby switched OFF. Then, thereafter, the processing goes back to step S18.

That is, with an incoming of the print command, the pressurizing roller (lower heat roller) 54 generates the heat quantity of 700 W. With this heat generation, the monochromatic printing is commanded. Hereat, the heat roller (upper heat roller) 50 generates the heat quantity of 450 W. Further, when the multi-color printing is commanded, the heat roller (upper heat roller) 50 generates the heat quantity of 1550 W. Moreover, when the full color printing is commanded, the heat roller (upper heat roller) 50 generates a heat quantity of 3800 W.

In this way, the heat quantity generated by the pressurizing roller 54 is fixed, while the heat quantity generated by the heat roller 50 is varied corresponding to a print mode. Hence, an efficiency of the toner dissolution is improved, and the electric power of dissipation can be remarkably reduced. Also, the heat quantity generated by the pressurizing roller 54 is fixed, and hence, even when the double-side printing is carried out, the fixed toner image is not disturbed. Further, the temperature of the heat roller 50 is fixed, whereby the offset can be prevented.

Thus, the fixing energy is reduced with the monochromatic printing. Therefore, first, the toner offset with respect to the heat roller 50 is prevented, since the set temperature of the heat roller 50 on the side of the toner image is controlled to the fixed value. Second, a supply quantity of the electric power to the pressurizing roller 54 is fixed, and, at the same time, a supply quantity of the electric power to the heat roller 50 is varied depending on the monochrome or the multiple colors of the toner image. With this arrangement, since the fixing is effected by the energy of the heat troller 50, a good fixing efficiency is exhibited for the application energy. Accordingly, the electric power of dissipation can be remarkably reduced. Further, the dissipation quantity of the electric power of the pressurizing roller 54 does not vary, and, besides, the set temperature does not change either. It is therefore feasible to prevent the image from being disturbed due to the dissolution of the fixed toner image even when the double-printing is performed.

Figure 9:
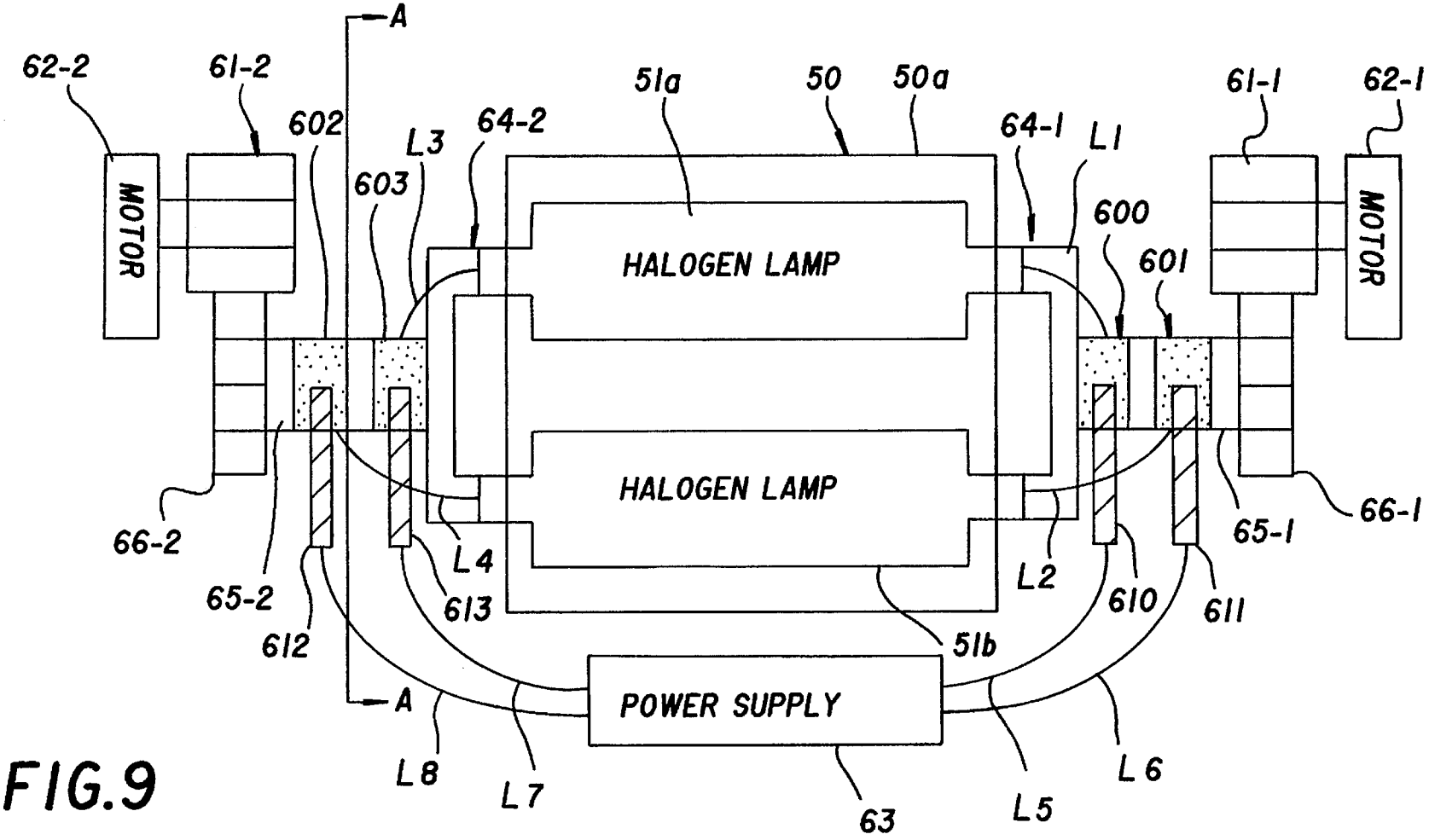
FIG. 9 is a sectional view illustrating another embodiment of the present invention.
Figure 10:
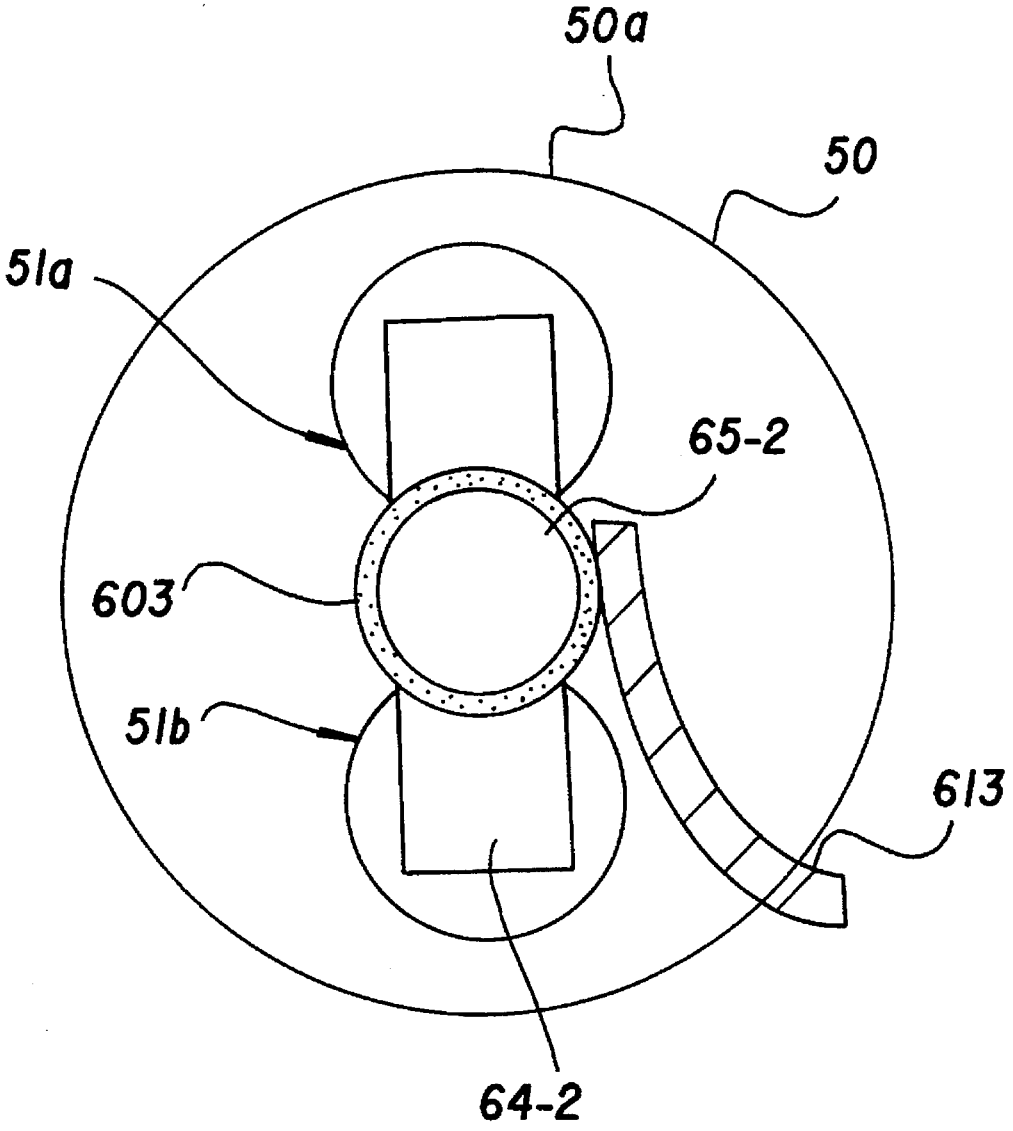
FIG. 10 is a sectional view taken along the line A—A in the embodiment of FIG. 9.

FIG. 9 is a sectional view showing another embodiment of the present invention. FIG. 10 is a sectional view eaken along the line A—A of FIG. 9. In this embodiment, two pieces of halogen lamps are provided in the heat roller body 50*a*.

As illustrated in FIG. 9, the two halogen lamps 51*a*, 51*b* are held by holding plates 64-1, 64-2 at both edges. The holding plates 64-1, 64-2 are provided with rotary shafts 65-1, 65-2. Pairs of conductive rings 600, 601 and 602, 603 are attached to the rotary shafts 65-1, 65-2.

Connection lines L1–L4 of the halogen lamps 51*a*, 51*b* are connected to the respective conductive rings 600– 603. Conductive contact members 610–613 are in contact with the individual conductive rings 600–603. Then, connection lines L5–L8 extending from the power supply 63 are connected to the conductive contact members 610–613.

Further, gears 66-1, 66-2 are formed on end portions of the rotary shafts 65-1, 65-2. These gears 66-1, 66-2 are engaged with drive gears 61-1, 61-2 formed on shafts of motors 62-1, 62-2.

In accordance with this embodiment, the power supply 63 is connected to the halogen lamps 51*a*, 51*b* by making the conductive rings 600–603 contact with the conductive members 610–613. A constraint in the rotary angle due to twists of the connection lines is thereby eliminated, with the result that the halogen lamps 51*a*, 51*b* are rotatable in one direction. Accordingly, the rotational control is facilitated.

In addition to the embodiment discussed above, the present invention can be modified as follows. First, the image forming apparatus has been explained in the form of the electrophotographic mechanism but is applicable to a printing mechanism (e.g., an electrostatic recording mechanism, etc.) for transferring the toner image in the embodiment discussed above. Second, the sheet is not confined to the paper but may involve the use of other mediums. Third, the image forming apparatus has been explained in the form of the printer but may be other types of image forming apparatus such as a copying machine, a facsimile, etc.. Fourth, the transfer unit has been explained in the form of the transfer roller but may be a transfer charger. Fifth, the heat source has been described in the form of the halogen lamp but may involve the use of other heater elements.

The present invention has been discussed so far by way of the embodiments but can be modified in a variety of forms within the range of the gist of the present invention. These modifications are not excluded from the scope of the present invention.

As discussed above, according to the present invention, when operating the heating member without rotating the roller body, the plurality of heating members are rotated. Therefore, even when operating some of the heating members, the surface temperatures of the roller body can be uniformized. Hence, in the standby status, when the print command comes, the fixing is immediately conducted. Even in such a case, an unevenness in the fixing can be prevented.

What is claimed is:

1. A heat roller fixing appartus for performing a thermal fixation onto a sheet by rotating a heat roller, comprising:

a heat roller including a roller body and a plurality of heating means provided in the interior of said roller body;

pressurizing means provided in a face-to-face relationship with said heat roller;

rotating means for said plurality of heating mens along an inner periphery of said roller body; and control means for drive-controlling said rotating means during a standby status for driving said heating means without rotating said roller body.

2. A heat roller fixing apparatus according to claim 1, wherein said control means causes reciprocating motions of said plurality of heating means by driving said rotating means.

3. A heat roller fixing apparatus according to claim 1, wherein said control means rotates said plurality of heating means in one direction by driving said rotating means.

4. A heat roller fixing apparatus according to claim 1, further comprising:

a plurality of temperature detecting means for detecting surface temperatures of said roller body in a plurality of positions of said roller body, wherein said control means, during the standby status, drives said rotating means when a difference between temperatures detected by said plurality of temperature detecting means is a predetermined temperature or higher.

5. A heat roller fixing apparatus according to claim 1, wherein said control means selectively drives one of said plurality of heating means during the standby status.

6. A heat roller fixing apparatus according to claim 1, wherein said control means selectively drives said plurality of heating means in accordance with designations of monochromatic printing/color printing which are given from the outside when performing a print.

7. A heat roller fixing apparatus according to claim 1, wherein said rotating means includes holding means for holding edges of said plurality of heating means and driving means for rotating said holding means.

8. A heat roller fixing apparatus according to claim 7, wherein said driving means are formed with drive gears, and said holding means have a multiplicity of teeth, formed along the peripheries, for meshing with said drive gears.

9. A heat roller fixing apparatus according to claim 1, wherein each of said plurality of heating means is a halogen lamp.

* * * * *